US006813600B1

(12) United States Patent
Casey, III et al.

(10) Patent No.: US 6,813,600 B1
(45) Date of Patent: Nov. 2, 2004

(54) PRECLASSIFICATION OF AUDIO MATERIAL IN DIGITAL AUDIO COMPRESSION APPLICATIONS

(75) Inventors: William J. Casey, III, Annandale, NJ (US); Nicholas G. Karter, Westfield, NJ (US); Deepen Sinha, Chatham, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 773 days.

(21) Appl. No.: 09/656,743

(22) Filed: Sep. 7, 2000

(51) Int. Cl.[7] ..... G10L 19/00
(52) U.S. Cl. ..... 704/200.1; 704/501
(58) Field of Search ..... 704/200, 200.1, 704/500–504

(56) References Cited

U.S. PATENT DOCUMENTS

| | | | | |
|---|---|---|---|---|
| 5,682,463 A | * | 10/1997 | Allen et al. | 704/230 |
| 5,959,944 A | * | 9/1999 | Dockes et al. | 369/84 |
| 6,310,652 B1 | * | 10/2001 | Li et al. | 704/503 |
| 6,542,869 B1 | * | 4/2003 | Foote | 704/200.1 |

FOREIGN PATENT DOCUMENTS

| | | |
|---|---|---|
| EP | 0 645 769 A2 | 3/1995 |
| EP | 0 803 989 A1 | 10/1997 |
| EP | 0 966 109 A2 | 12/1999 |
| WO | WO 95/02928 | 1/1995 |

OTHER PUBLICATIONS

D. Sinha, J.D. Johnston, S. Dorward and S.R. Quackenbush, "The Perceptual Audio Coder," Digital Audio, Section 42, pp. 42–1 to 42–18, CRC Press, 1998.

N.S. Jayant and E.Y. Chen, "Audio Compression: Technology and Applications," AT&T Technical Journal, vol. 74, No. 2, pp. 23–34, Mar.–Apr. 1995.

T. Painter and A. Spanias, "Perceptual Coding of Digital Audio," Proceedings of the IEEE, vol. 88, No. 4, pp. 451–513, Apr. 2000.

S.N. Levine et al. "A Switched Parametric & Transform Audio Coder," IEEE, vol. 2, pp. 985–988, 1999.

* cited by examiner

*Primary Examiner*—David D. Knepper

(57) ABSTRACT

Audio tracks or other portions of a particular type of audio material to be encoded are analyzed to determine a value of at least one coding-related parameter suitable for providing optimal encoding of the particular type of audio material. When a given portion of the audio material is to be encoded for transmission in a perceptual audio coder of a communication system, the value of the coding-related parameter is identified and then utilized in conjunction with the encoding of the given portion. The determined value of the coding-related parameter may be at least a portion of a psychoacoustic model utilized in encoding the given portion of the particular type of audio material in the perceptual audio coder. As another example, the value of the coding-related parameter may be a setting of an audio processor utilized to process the given portion of the particular type of audio material prior to encoding the given portion in the perceptual audio coder.

28 Claims, 4 Drawing Sheets

PRECLASSIFICATION OF AUDIO MATERIAL IN DIGITAL AUDIO COMPRESSION APPLICATIONS

FIELD OF THE INVENTION

The present invention relates generally to audio compression techniques, and more particularly to audio compression techniques which utilize psychoacoustic models or other types of perceptual models.

BACKGROUND OF THE INVENTION

Perceptual audio coding techniques have been proposed for use in numerous digital communication systems, such as, e.g., terrestrial AM or FM in-band on-channel (IBOC) digital audio broadcasting (DAB) systems, satellite broadcasting systems, and Internet audio streaming systems. Perceptual audio coding devices, such as the perceptual audio coder (PAC) described in D. Sinha, J. D. Johnston, S. Dorward and S. R. Quackenbush, "The Perceptual Audio Coder," in Digital Audio, Section 42, pp. 42-1 to 42-18, CRC Press, 1998, which is incorporated by reference herein, perform audio coding using a noise allocation strategy whereby for each audio frame the bit requirement is computed based on a psychoacoustic model. PACs and other audio coding devices incorporating similar compression techniques are inherently packet-oriented, i.e., audio information for a fixed interval (frame) of time is represented by a variable bit length packet. Each packet includes certain control information followed by a quantized spectral/subband description of the audio frame. For stereo signals, the packet may contain the spectral description of two or more audio channels separately or differentially, as a center channel and side channels (e.g., a left channel and a right channel).

PAC encoding as described in the above-cited reference may be viewed as a perceptually-driven adaptive filter bank or transform coding algorithm. It incorporates advanced signal processing and psychoacoustic modeling techniques to achieve a high level of signal compression. More particularly, PAC encoding uses a signal adaptive switched filter bank which switches between a Modified Discrete Cosine Transform (MDCT) and a wavelet transform to obtain a compact description of the audio signal. The filter bank output is quantized using non-uniform vector quantizers. For the purpose of quantization, the filter bank outputs are grouped into so-called "coderbands" so that quantizer parameters, e.g., quantizer step sizes, may be independently chosen for each coderband. These step sizes are generated in accordance with a psychoacoustic model. Quantized coefficients are further compressed using an adaptive Huffman coding technique. PAC employs, e.g., a total of 15 different codebooks, and for each codeband, the best codebook may be chosen independently. For stereo and multichannel audio material, sum/difference or other forms of multichannel combinations may be encoded.

PAC encoding formats the compressed audio information into a packetized bitstream using a block sampling algorithm. At a 44.1 kHz sampling rate, each packet corresponds to 1024 input samples from each channel, regardless of the number of channels. The Huffman encoded filter bank outputs, codebook selection, quantizers and channel combination information for one 1024 sample block are arranged in a single packet. Although the size of the packet corresponding to each 1024 input audio sample block is variable, a long-term constant average packet length may be maintained as will be described below.

Depending on the application, various additional information may be added to the first frame or to every frame. For unreliable transmission channels, such as those in DAB applications, a header is added to each frame. This header contains critical PAC packet synchronization information for error recovery and may also contain other useful information such as sample rate, transmission bit rate, audio coding modes, etc. The critical control information is further protected by repeating it in two consecutive packets.

It is clear from the above description that the PAC bit demand depends primarily on the quantizer step sizes, as determined in accordance with the psychoacoustic model. However, due to the use of Huffman coding, it is generally not possible to predict the precise bit demand in advance, i.e., prior to the quantization and Huffman coding steps, and the bit demand varies from frame to frame. Conventional PAC encoders therefore utilize a buffering mechanism and a rate loop to meet long-term bit rate constraints. The size of the buffer in the buffering mechanism is determined by the allowable system delay.

In conventional PAC bit allocation, the encoder issues a request for allocation of a certain number of bits for a particular audio frame to a buffer control mechanism. Depending upon the state of the buffer and the average bit rate, the buffer control mechanism then returns the maximum number of bits which can actually be allocated to the current frame. It should be noted that this bit assignment can be significantly lower than the initial bit allocation request. This indicates that it may not be possible to encode the current frame at an accuracy level for perceptually transparent coding, i.e., as implied by the initial psychoacoustic model step sizes. It is the function of the rate loop to adjust the step sizes so that bit demand with the modified step sizes is less than, and close to, the actual bit allocation.

Despite the above-described advances provided by PAC coding, a need remains for further improvements in techniques for digital audio compression, so as to provide enhanced performance capabilities in DAB systems and other digital audio compression applications. In all of these applications, one generally strives to deliver the best audio playback quality given the bandwidth constraint. Conventional audio coding techniques such as PAC attempt to maximize audio quality for a wide range of audio signals. For non-real-time applications it is possible to tune the encoder separately for each audio track so that playback quality is maximized. Such tuning can significantly enhance the playback quality. However, in digital broadcasting and other real-time applications it is generally not possible to change the encoder "on the fly." As a result, given the richness and diversity of available audio material, the playback quality is somewhat compromised when a single psychoacoustic model is used for all of the different types of available audio material. More particularly, since different types of audio material, such as rock,jazz, classical, voice, etc., can have significantly different characteristics, the typical conventional approach of applying a single psychoacoustic model to all types of audio material inevitably results in less than optimal encoding performance for one or more particular types of audio material.

Another problem with conventional PAC coding relates to the audio processor which typically precedes the PAC audio encoder in a DAB system or other type of system. The audio processor performs processing functions such as attempting to reduce the dynamic range, stereo separation or bandwidth of an audio signal to be encoded. Like the PAC encoder itself, the settings or other parameters of the audio processor are typically not optimized for particular types of audio material in real-time applications.

A need therefore exists for a technique for preclassification of audio material so as to facilitate determination of an appropriate psychoacoustic model, audio processor setting or other coding-related parameter for use in perceptual audio coding of such material.

SUMMARY OF THE INVENTION

The present invention provides methods and apparatus for preclassification of audio material in digital audio compression applications. Advantageously, the invention ensures that appropriate psychoacoustic models, audio processor settings or other coding-related parameters are used for particular types of audio material, and thus improves the playback quality associated with the audio compression process.

In accordance with one aspect of the invention, audio tracks or other portions of a particular type of audio material to be encoded are analyzed to determine a value of at least one coding-related parameter suitable for providing a desired level of audio playback quality, e.g., an optimal encoding of the particular type of audio material. When a given portion of the particular type of audio material is to be encoded for transmission in a perceptual audio coder of a communication system, the value of the coding-related parameter is identified and then utilized in conjunction with the encoding of the given portion. The given portion of the particular type of audio material may be analyzed to determine the value of the coding-related parameter prior to encoding of the given portion in the perceptual audio coder. As another example, the given portion of the particular type of audio material may be analyzed to determine the value of the coding-related parameter at least in part during the encoding of the given portion in the perceptual audio coder.

The coding-related parameter in an illustrative embodiment comprises a psychoacoustic model specified at least in part as a combination of one or more of a tone masking noise ratio, a noise masking tone ratio, and a frequency spreading function. The value of the coding-related parameter in this case may be determined at least in part based on analysis which includes a determination of at least one of an average spectral flatness measure, an average energy entropy measure, and a coding criticality measure.

In accordance with a further aspect of the invention, the value of the coding-related parameter may comprise a setting of an audio processor utilized to process the given portion of the particular type of audio material prior to encoding the given portion in the perceptual audio coder. In this case, the value of the coding-related parameter may be determined based at least in part on an undercoding measure generated by analyzing at least part of the given portion of the particular type of audio material. Again, this analysis can be performed prior to or during the encoding of the audio material.

The invention can be utilized in a wide variety of digital audio compression applications, including, for example, AM or FM in-band on-channel (IBOC) digital audio broadcasting (DAB) systems, satellite broadcasting systems, Internet audio streaming, systems for simultaneous delivery of audio and data, etc.

DETAILED DESCRIPTION OF THE INVENTION

Figure 1:
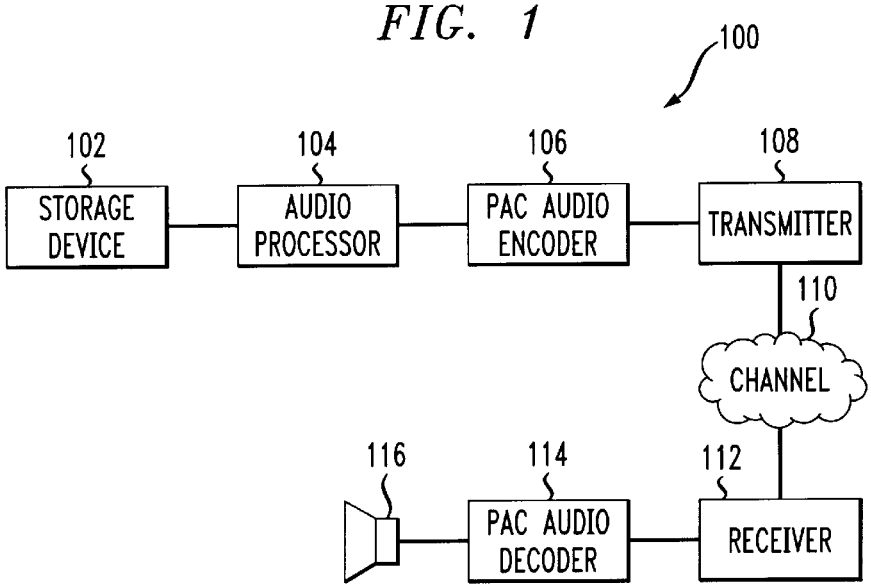
FIG. 1 shows a block diagram of an illustrative embodiment of a communication system in which the present invention may be implemented.

FIG. 1 shows a communication system 100 having a audio material preclassification feature in accordance with the present invention. The system 100 includes a storage device 102, an audio processor 104, a PAC audio encoder 106 and a transmitter 108. In operation, the system 100 retrieves an audio signal from the storage device 102, processes the audio signal in the audio processor 104, and encodes the processed audio signal in the PAC audio encoder 106 using a perceptual audio coding process. The transmitter 108 transmits the encoded audio signal over a channel 110 to a receiver 112 of the system 100. The output of the receiver 112 is applied to a PAC audio decoder 114 which reconstructs the original audio signal and delivers it to an audio output device 116 which may be a speaker or set of speakers.

In accordance with one aspect of the present invention, the PAC audio encoder 106 is configured to analyze the retrieved audio signal so as to determine an appropriate psychoacoustic model for use in the perceptual audio coding process.

Figure 2:
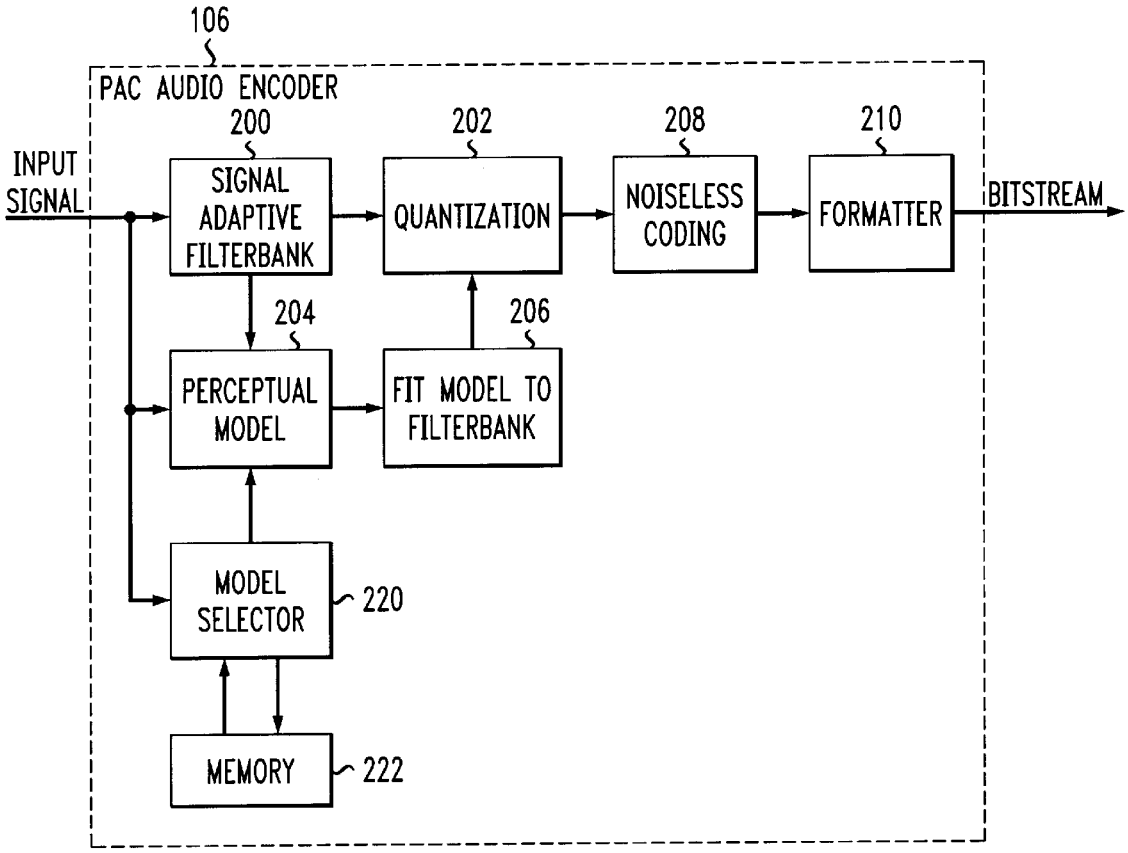
FIG. 2 shows a block diagram of an example perceptual audio coder (PAC) audio encoder configured in accordance with the present invention.

FIG. 2 shows an illustrative embodiment of the PAC audio encoder 106 in greater detail. The retrieved audio signal after processing in the audio processor 104 is applied as an input signal to a signal adaptive filterbank 200 which switches between an MDCT and a wavelet transform. The filterbank outputs are grouped into so-called "coderbands" and then quantized in a quantization element 202 using non-uniform vector quantizers, with quantization step sizes independently chosen for each coderband. The step sizes are generated by a perceptual model 204 operating in conjunction with a fitting element 206. The quantized coefficients generated by quantization element 202 are further compressed using a noiseless coding element 208 which in this example implements an adaptive Huffman coding scheme. Additional details regarding conventional aspects of PAC encoding can be found in the above-cited reference D. Sinha, J. D. Johnston, S. Dorward and S. R. Quackenbush, "The Perceptual Audio Coder," Digital Audio, Section 42, pp. 42-1 to 42-18, CRC Press, 1998.

The PAC audio encoder 106 as shown in FIG. 2 further includes a model selector 220 which operates in conjunction with a memory 222. The model selector 220 receives and processes the input audio signal in order to determine an optimum psychoacoustic model for use in encoding that particular audio signal. The model selector 220 may store information regarding a number of different psychoacoustic models in the memory 222, such that when the model selector 220 selects a particular one of the models for use with the particular input signal, the corresponding information can be retrieved from memory 222 and delivered to the perceptual model element 204 for use in the encoding process.

The present invention thus dynamically optimizes the performance of the PAC audio encoder 106 by assigning the most appropriate psychoacoustic model to the particular audio signal being encoded. As noted previously, different types of audio material, such as rock, jazz, classical, voice, etc. may each require a different psychoacoustic model in order to achieve optimum encoding. The conventional approach of applying a single psychoacoustic model to all types of audio material thus inevitably results in less than optimal encoding performance for each type of audio material. The present invention overcomes this problem by configuring the PAC audio encoder 106 for dynamic selection of a particular psychoacoustic model based on the characteristics of the particular audio material to be encoded.

Figure 3:
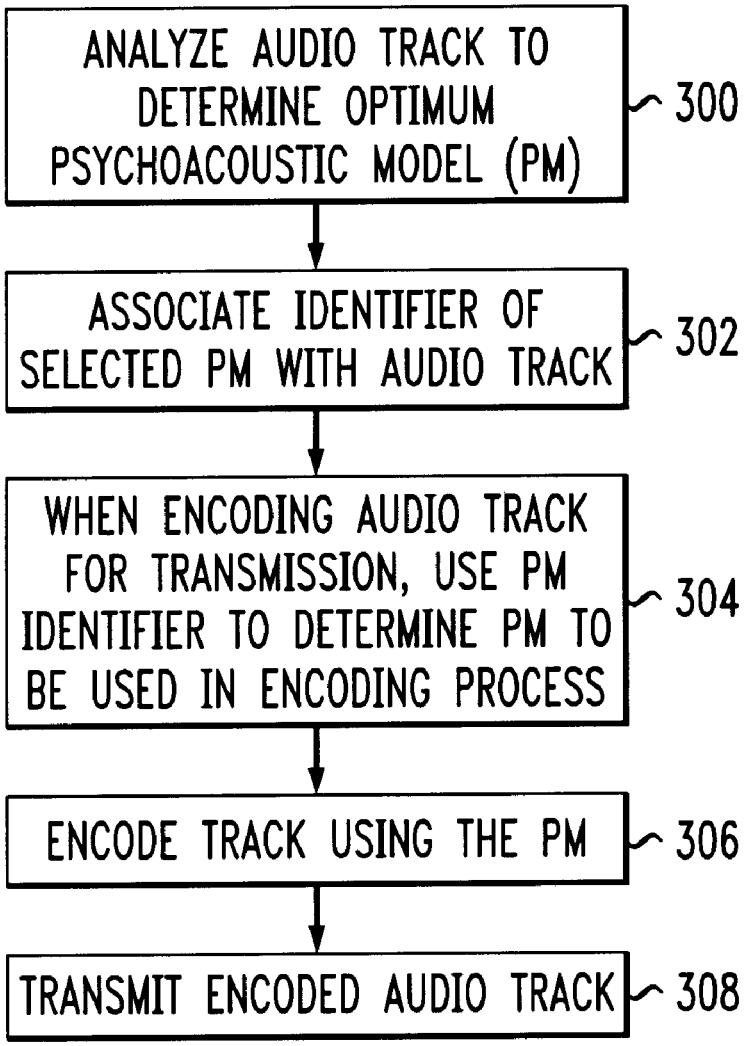
FIGS. 3 and 4 are flow diagrams of example audio preclassification processes in accordance with the present invention.

FIG. 3 is a flow diagram illustrating an example audio material preclassification process that may be implemented in the system 100 of FIG. 1. It is assumed for this example that the audio material comprises a full-length audio track, such as an audio track on a compact disk (CD) or other storage medium, although it should be understood that the described techniques are more generally applicable to other types and configurations of audio material. For example, the invention can be applied to portions of audio tracks, or to sets of multiple audio tracks.

The processing illustrated in FIG. 3 is an example of a batch mode processing technique in accordance with the present invention. In step 300, an audio track to be stored on the storage device 102 is analyzed to determine an optimum psychoacoustic model (PM) for use in the audio encoding process implemented in the PAC audio encoder 106. The manner in which an optimum PM is determined for a given audio track will be described in greater detail below.

It should be noted that the terms "optimum" and "optimal" as used herein should not be construed as requiring a particular level of performance, such as an absolute maximum value for a particular playback quality measure, but should instead be construed more generally to include any desired level of performance for a given application.

In step 302, an identifier of the determined PM is associated with the audio track. For example, a particular field of the audio track as stored on the storage device 102 may be designated to contain the associated PM for that track. When the audio track is to be subsequently encoded for transmission, as indicated in step 304, the PM identifier associated with the track is determined by model selector 220 and used to provide appropriate PM information to the PM element 204. The PM identifier may be delivered to the PAC audio encoder 106 through an existing interconnection with one or more other system elements, such as, e.g., an existing conventional AES3 interconnection. The audio track is then encoded in step 306 in the PAC audio encoder 106 using the PM associated with that track, and the encoded audio track is transmitted by the system transmitter 108 in step 308.

The analysis of the audio track in step 300 of FIG. 3 may be performed using an audio analyzer implemented in the system 100 as a set of one or more audio analyzer software programs, a stand-alone hardware device, or combinations of software and hardware. Such programs may utilize Fast Fourier Transforms (FFTs) or other signal analysis techniques to determine which PM is best for the particular audio track, as will be described in greater detail below. The programs may be configured to automatically select the appropriate PM, or can provide interaction with a user to select the appropriate PM. For example, an audio analyzer suitable for use with the present invention can be configured to allow the user to identify particular instruments, sounds or other parameters that he or she wants to stress, and to select the PM which provides optimum encoding for the identified parameters. Such an audio analyzer may be implemented using the model selector 220 and memory 222 of the PAC audio encoder 106. In other embodiments, the audio analyzer may be implemented in a separate system element or set of elements.

Figure 4:
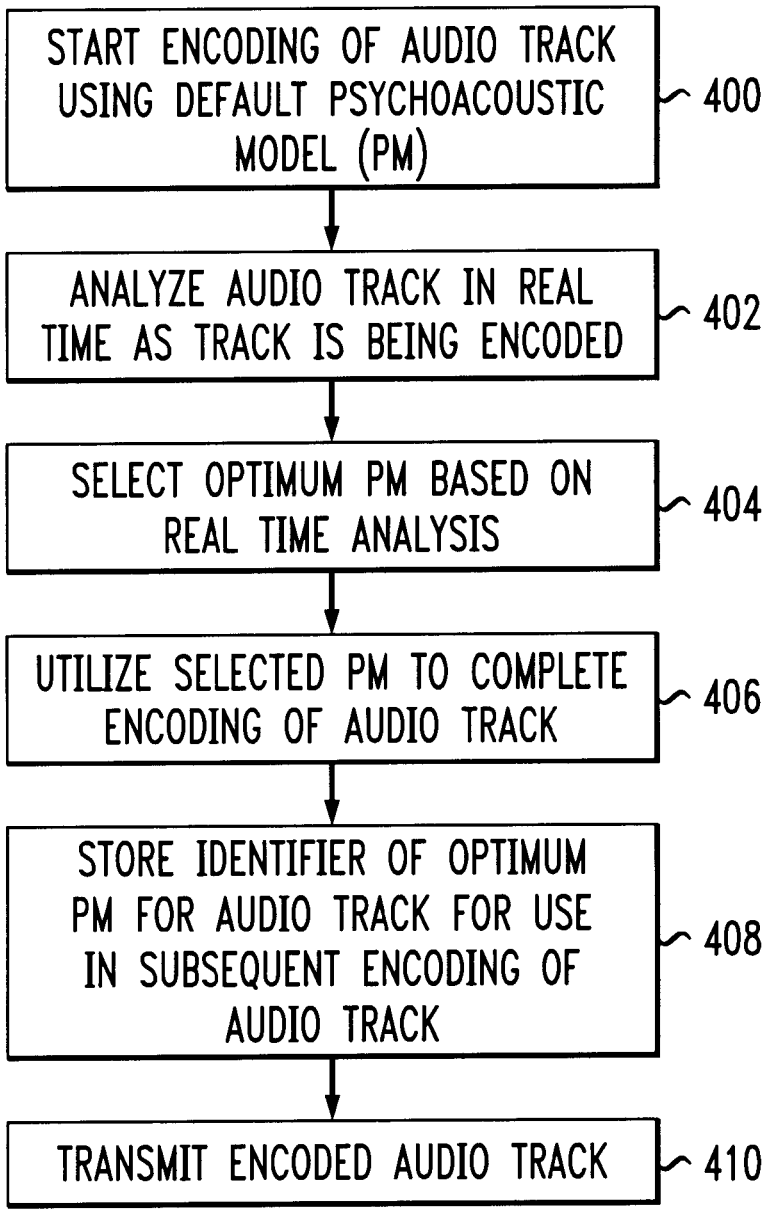

FIG. 4 is a flow diagram of another example audio material preclassification process in accordance with the invention. This example operates on a given audio track in real time, as the track is being encoded for transmission, rather than using the batch mode technique previously described in conjunction with FIG. 3. In step 400, the encoding of the audio track is started using a default PM. The default PM may be a conventional PM typically used for encoding a variety of different types of audio material. In step 402, the audio track is analyzed in real time, as the track is being encoded, using the above-noted audio analyzer. Based on this real-time analysis, the optimum PM for the particular audio track is selected, as shown in step 404. In step 406, the selected optimum PM is used to complete the encoding of the audio track. The identifier of the optimum PM for the audio track is stored in step 408 for use in subsequent encoding of that audio track, and the encoded audio track is transmitted in step 410.

The above-noted field of the audio track as stored in storage device 102 may be updated to include the identifier of the optimum PM. When the same track is subsequently retrieved for retransmission, the system can determine that an optimum PM has already been selected for that track, and the system can proceed directly to encoding with that PM using steps 304 to 308 of FIG. 3. The analysis steps 300 and 302 of FIG. 3 or 400, 402 and 404 of FIG. 4 therefore need only be applied when dealing with audio tracks for which an optimum PM has not yet been determined. Such a condition may be indicated by a particular identifier in the above-noted PM field, the absence of such an identifier, or other suitable technique.

The manner in which an optimum PM for use in encoding a particular audio track is determined will now be described in greater detail. This portion of the description will also describe the manner in which values of various parameters for use in the audio processor 104 can be determined for a particular audio track. The techniques described below provide a detailed example of one possible implementation of the above-noted audio analyzer.

The preclassification process of the present invention in the illustrative embodiment preclassifies full-length audio tracks into one of several classes. Associated with each of these classes are two sets of parameters, one for use in the PAC audio encoder 106, and the other for use in the audio processor 104. The audio processor 104 in this embodiment may be of a type similar to an Optimod 6200 DAB processor from Orban, http://www.orban.com.

The first set of parameters is referred to as PAC psychoacoustic model (PM) parameters. These parameters are used in the PM element 204 of PAC audio encoder 106 during the actual encoding of an audio signal. The nature and impact of these parameters and the classification of the audio signal for this purpose are described in greater detail below.

The second set of parameters in the illustrative embodiment includes a single parameter referred to as an average criticality measure. Generation and use of this parameter in the selection of audio processor settings is also discussed in greater detail below.

As described in the above-cited reference D. Sinha, J. D. Johnston, S. Dorward and S. R. Quackenbush, "The Perceptual Audio Coder," Digital Audio, Section 42, pp. 42-1 to 42-18, CRC Press, 1998, the PM used in a conventional PAC audio encoder employs a variety of concepts to generate the step size. Fourier analysis is performed on the signal to compute spectral power in each of the coderbands. A tonality measure is computed for each of the coderbands and models the relative smoothness of the signal envelope. Based on the tonality measure, a target power for the quantization noise, referred to as Signal to Mask Ratio (SMR), is computed. For pure tone signals, the desired SMR is designated as Tone Masking Noise (TMN) ratio, and for pure noise, the SMR is designated as Noise Masking Tone (NMT). The value of TMN is typically chosen in the range of 24–35 dB and NMT is in the range of 4–9 dB.

Figure 5A:
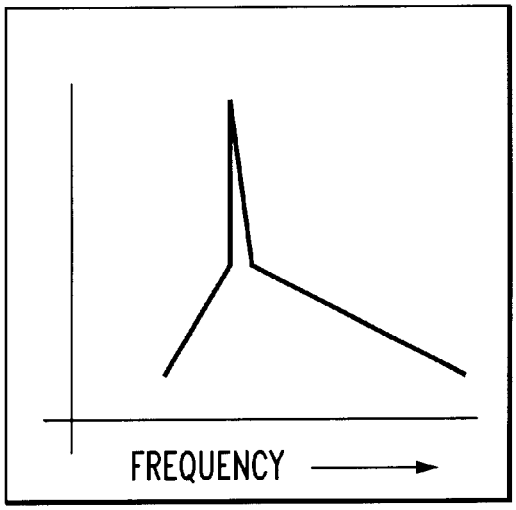
FIGS. 5A and 5B show example frequency spreading functions for use in conjunction with the present invention.
Figure 5B:
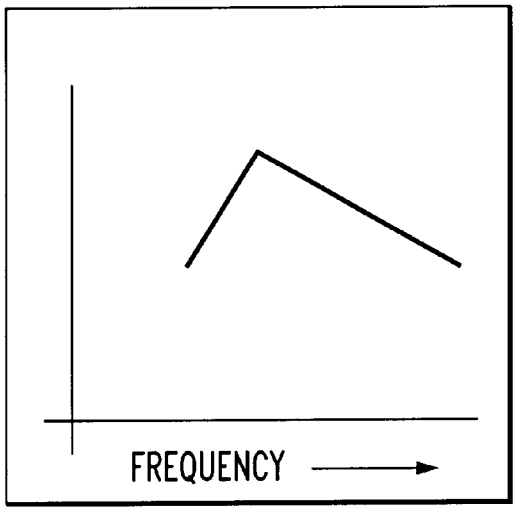

Another concept utilized in computing the step size is that of the frequency spread of simultaneous masking, which essentially indicates that signal power at one frequency masks noise power not only at that frequency but also at nearby frequencies. Based on this, the SMR requirements for one coderband may be relaxed by looking at the spectral shape in nearby frequency bands. Various possible shapes for the frequency spreading function (SF) are known in the art. Two examples are shown in FIGS. 5A and 5B.

It was noted previously that the rate loop in a conventional PAC coding process operates based on psychoacoustic principles to minimize the perception of excess noise. However, often a severe and audible amount of undercoding may be necessary to meet the rate constraints. The undercoding is particularly noticeable at lower bit rates and for certain types of signals. A measure of average undercoding during the encoding process therefore also provides a measure of the criticality of the audio signal for the purpose of PAC coding. This undercoding (UC) measure may be computed by running a given audio track, e.g., an audio track to be analyzed by the above-noted audio analyzer, through a PAC audio encoder. The encoder can be configured to produce a running or average UC measure for the given audio track, and the UC measure may be used in a preclassification process in accordance with the invention.

The following is an example of a set of three PAC PM parameters that may differ for each of a given set of classes of audio material:

1. TMN. A higher TMN generally leads to more accurate coding of tonal sounds, resulting in cleaner audio when sufficient bits are available. However, requiring a higher TMN may lead to increased aliasing distortions in a bit starvation situation.

2. NMT. Lower NMT generally leads to a cleaner sound and less echo distortions. However, for critical signals, higher NMT can lead to more aliasing distortion.

3. Shapes of the spreading function (SF). The shape shown in FIG. 5A is generally suitable for signals which demonstrate a preponderance of clearly defined peaks in the frequency and/or time domain. However, this shape is also more demanding in terms of its bit requirement. For signals without sharp time/frequency peaks, the shape shown in FIG. 5B will generally be preferable, particular in a bit starvation situation.

A particular set of values for the above-listed PAC PM parameters thus in the illustrative embodiment specifies a particular psychoacoustic model. In order to select the particular set of values, and thereby the psychoacoustic model, most appropriate for a given audio track, the audio track is first analyzed, e.g, using the above-noted audio analyzer, to determine the following three measures:

1. Average Spectral Flatness Measure (ASFM). SFM is defined in N. S. Jayant and P. Noll, "Digital Coding of Waveforms, Principles and Applications to Speech and Video," Englewood Cliffs, N.J., Prentice-Hall, 1984, which is incorporated by reference herein. In accordance with the present invention, a given audio signal may be broken into small contiguous segments of about 20 to 25 milliseconds each, and for each segment the SFM is computed. These values are then averaged over the entire audio track to compute ASFM.

2. Average Energy Entropy (AEN). Energy entropy (EN) is defined in D. Sinha and A. H. Tewfik, "Low Bit Rate Transparent Audio Compression using Adapted Wavelets," IEEE Transactions on Signal Processing, Vol. 41, No. 12, pp. 3463–3479, December 1993, which is incorporated by reference herein, and measures the "peakiness" of the audio signal in the time domain. In accordance with the present invention, EN is computed over small contiguous segments of about 20 to 25 milliseconds each, and then averaged to compute AEN for the audio track.

3. Coding criticality measure. This is the UC measure described above.

In the illustrative embodiment of the invention, the three measures, ASFM, AEN, and UC, as generated for a given audio track, are combined in a decision mechanism to choose a suitable value for each of the three PAC PM parameters TMN, NMT, and SF for that audio track. As previously noted, a given set of values for the PM parameters thus represents a particular psychoacoustic model. The particular psychoacoustic model is then associated with the given audio track in the manner described in conjunction with the flow diagrams of FIGS. 3 and 4. Qualitatively, if ASFM is below a designated threshold and UC is also below a designated threshold, a higher TMN provides better encoding. Similarly, if AEN is below a designated threshold and UC is also below threshold, a higher NMT provides better encoding. Finally, if UC is below threshold or ASFM and AEN are both below threshold, the SF shape shown in FIG. 5A provides better overall audio quality.

The above-noted criticality measure UC as determined for a given audio track may also be used to select one or more settings for the audio processor 104. The audio processor settings may be adjusted by an operator or automatically using one or more control mechanisms so as to maintain the UC measure below a designated threshold. This criterion can be used in conjunction with other conventional criteria to fine tune a preset in the audio processor 104 and/or to determine a new preset for use with the given audio track.

As previously noted, the present invention can be implemented in a wide variety of different digital audio transmission applications, including terrestrial DAB systems, satellite broadcasting systems, and Internet streaming systems. The particular preclassification techniques described in conjunction with the illustrative embodiment above are shown by way of example only, and are not intended to limit the scope of the invention in any way. For example, other analysis techniques and signal measures may be used to classify audio material and associate a particular psychoacoustic model, audio processor setting or other coding-based parameter therewith in accordance with the present invention. These and numerous other alternative embodiments and implementations within the scope of the following claims will be apparent to those skilled in the art.

What is claimed is:

1. A method of processing audio information to be encoded in a perceptual audio coder, the method comprising the steps of:

preclassifying a particular type of audio material by (i) determining a value of at least one coding-related parameter suitable for use in encoding the particular type of audio material in the perceptual audio encoder, the at least one coding-related parameter being indicative of at least one of a psychoacoustic model and an audio processor setting, and (ii) storing the value of the at least one coding-related parameter in association with an identifier of the particular type of audio material; and in conjunction with subsequent encoding of audio material of the particular type in the perceptual audio coder, retrieving the stored identifier and utilizing the corresponding determined value of the coding-related parameter in the subsequent encoding of the audio material of the particular type.

2. The method of claim 1 wherein a given portion of the particular type of audio material to be encoded comprises an audio track.

3. The method of claim 1 wherein the value of at least one coding-related parameter comprises at least a portion of a psychoacoustic model utilized in encoding a given portion of the particular type of audio material in the perceptual audio coder.

4. The method of claim 1 wherein the value of at least one coding-related parameter comprises a setting of an audio processor utilized to process a given portion of the particular type of audio material prior to encoding the given portion in the perceptual audio coder.

5. The method of claim 1 further including the step of analyzing a given portion of the particular type of audio material to determine the value of the coding-related parameter.

6. The method of claim 5 wherein the given portion of the particular type of audio material to be encoded is analyzed prior to encoding of the given portion of the particular type of audio material in the perceptual audio coder.

7. The method of claim 5 wherein the given portion of the particular type of audio material to be encoded is analyzed at least in part during the encoding of the given portion of the particular type of audio material in the perceptual audio coder.

8. The method of claim 1 wherein an identifier of the value of the coding-related parameter is stored in association with the identifier of the particular type of audio material.

9. The method of claim 1 wherein the value of the coding-related parameter is identified upon retrieval of a given portion of the particular type of audio material from a storage device by processing a corresponding identifier stored with the given portion of the particular type of audio material.

10. The method of claim 1 wherein the coding-related parameter comprises one or more of a tone masking noise ratio, a noise masking tone ratio, and a frequency spreading function.

11. The method of claim 10 wherein the coding-related parameter comprises a psychoacoustic model specified at least in part as a combination of the tone masking noise ratio, the noise making tone ratio, and the spreading function.

12. The method of claim 1 wherein the value of the coding-related parameter is determined at least in part based on an analysis of a given portion of the particular type of audio material, the analysis including a determination of at least one of an average spectral flatness measure, an average energy entropy measure, and a coding criticality measure.

13. The method of claim 1 wherein the coding-related parameter is determined based at least in part on an under-coding measure generated by analyzing at least part of a given portion of the particular type of audio material.

14. An apparatus for processing audio information to be encoded, the apparatus comprising:

a perceptual audio coder operative to preclassify a particular type of audio material by (i) determining a value of at least one coding-related parameter suitable for use in encoding the particular type of audio material in the perceptual audio encoder, the at least one coding-related parameter being indicative of at least one of a psychoacoustic model and an audio processor setting, and (ii) storing the value of the at least one coding-related parameter in association with an identifier of the particular type of audio material;

wherein the perceptual audio coder is further operative, in conjunction with subsequent encoding of audio material of the particular type in the perceptual audio coder, to retrieve the stored identifier and to utilize the corresponding determined value of the coding-related parameter in the subsequent encoding of the audio material of the particular type.

15. The apparatus of claim 14 wherein a given portion of the particular type of audio material to be encoded comprises an audio track.

16. The apparatus of claim 14 wherein a value of at least one coding-related parameter comprises at least a portion of a psychoacoustic model utilized in encoding the given portion of the particular type of audio material in the perceptual audio coder.

17. The apparatus of claim 14 wherein the value of at least one coding-related parameter comprises a setting of an audio processor utilized to process a given portion of the particular type of audio material prior to encoding the given portion in the perceptual audio coder.

18. The apparatus of claim 14 further including the step of analyzing a given portion of the particular type of audio material to determine the value of the coding-related parameter.

19. The apparatus of claim 18 wherein the given portion of the particular type of audio material to be encoded is analyzed prior to encoding of the given portion of the particular type of audio material in the perceptual audio coder.

20. The apparatus of claim 18 wherein the given portion of the particular type of audio material to be encoded is analyzed at least in part during the encoding of the given portion of the particular type of audio material in the perceptual audio coder.

21. The apparatus of claim 14 wherein an identifier of the value of the coding-related parameter is stored in association with the identifier of the particular type of audio material.

22. The apparatus of claim 14 wherein the value of the coding-related parameter is identified upon retrieval of a given portion of the particular type of audio material from a storage device by processing a corresponding identifier stored with the given portion of the particular type of audio material.

23. The apparatus of claim 14 wherein the coding-related parameter comprises one or more of a tone masking noise ratio, a noise masking tone ratio, and a frequency spreading function.

24. The apparatus of claim 23 wherein the coding-related parameter comprises a psychoacoustic model specified at least in part as a combination of the tone masking noise ratio, the noise making tone ratio, and the spreading function.

25. The apparatus of claim 14 wherein the value of the coding-related parameter is determined at least in part based on an analysis of a given portion of the particular type of audio material, the analysis including a determination of at least one of an average spectral flatness measure, an average energy entropy measure, and a coding criticality measure.

26. The apparatus of claim 14 wherein the coding-related parameter is determined based at least in part on an undercoding measure generated by analyzing at least part of a given portion of the particular type of audio material.

27. An apparatus for processing audio information to be encoded in a perceptual audio coder, the apparatus comprising:

an audio processor operative to preclassify a particular type of audio material by (i) determining a value of at least one coding-related parameter suitable for use in encoding the particular type of audio material in a perceptual audio encoder associated with the audio processor, the at least one coding-related parameter being indicative of at least one of a psychoacoustic model and an audio processor setting, and (ii) storing the value of the at least one coding-related parameter in association with an identifier of the particular type of audio material;

wherein, in conjunction with subsequent encoding of audio material of the particular type in the perceptual audio coder, the stored identifier is retrieved and the corresponding determined value of the coding-related parameter is utilized in the subsequent encoding of the audio material of the particular type.

28. An article of manufacture comprising a machine-readable storage medium for storing one or more software programs for use in processing audio information to be encoded in a perceptual audio coder, wherein the one or more software programs when executed implement the steps of:

preclassifying a particular type of audio material by (i) determining a value of at least one coding-related parameter suitable for use in encoding the particular type of audio material in the perceptual audio encoder, the at least one coding-related parameter being indicative of at least one of a psychoacoustic model and an audio processor setting, and (ii) storing the value of the at least one coding-related parameter in association with an identifier of the particular type of audio material; and in conjunction with subsequent encoding of audio material of the particular type in the perceptual audio coder, retrieving the stored identifier and utilizing the corresponding determined value of the coding-related parameter in the subsequent encoding of the audio material of the particular type.

* * * * *